US006619485B1

(12) United States Patent
Jenkins

(10) Patent No.: US 6,619,485 B1
(45) Date of Patent: Sep. 16, 2003

(54) LOCKABLE RACK FOR GRASS TRIMMERS

(76) Inventor: David Mark Jenkins, 6766 W. 800 North, Fairland, IN (US) 46126

( * ) Notice: Subject to any disclaimer, the term of this patent is extended or adjusted under 35 U.S.C. 154(b) by 0 days.

(21) Appl. No.: 10/124,698

(22) Filed: Apr. 10, 2002

(51) Int. Cl.[7] ..... A47F 7/00

(52) U.S. Cl. ..... 211/4; 211/70.6; 224/402; 224/405

(58) Field of Search ..... 211/70.6, 4, 60.1; 224/403, 402, 405

(56) References Cited

U.S. PATENT DOCUMENTS

| | | | | | |
|---|---|---|---|---|---|
| 763,461 | A | * | 6/1904 | Burton | |
| 867,996 | A | * | 10/1907 | McMillan | |
| 3,567,634 | A | * | 3/1971 | Mozelsio | 211/7 |
| 4,805,781 | A | * | 2/1989 | Tegel | 211/4 X |
| 5,647,489 | A | | 7/1997 | Bellis, Jr. | |
| 5,964,358 | A | | 10/1999 | Hafendorfer | |
| 6,053,339 | A | * | 4/2000 | Bellis | 211/70.6 |
| 6,073,781 | A | * | 6/2000 | Puglisi | 211/70.6 |
| 6,173,842 | B1 | | 1/2001 | Fitzgerald | |
| 6,182,840 | B1 | * | 2/2001 | Tegel | 211/85.1 |
| 6,302,280 | B1 | * | 10/2001 | Bermes | 211/70.6 |
| 6,409,029 | B1 | * | 6/2002 | Bermes | 211/70.6 |

* cited by examiner

*Primary Examiner*—Robert W. Gibson, Jr.
(74) *Attorney, Agent, or Firm*—Krieg DeVault Lundy LLP

(57) ABSTRACT

The disclosed invention provides for a lockable grass trimmer rack. The grass trimmer rack has inner frames and an outer frame. The outer frame slides vertically with respect to the inner frames to an open position or a closed position. The hooks on one side of the grass trimmer rack have slightly different inner diameters than the hooks on the opposite side of the grass trimmer rack to hold securely the larger diameter and small diameter ends of the grass trimmer. When the grass trimmer rack is in a closed position, the hooks clamp the grass trimmer in place and the equipment rack can be locked to prevent theft.

6 Claims, 4 Drawing Sheets

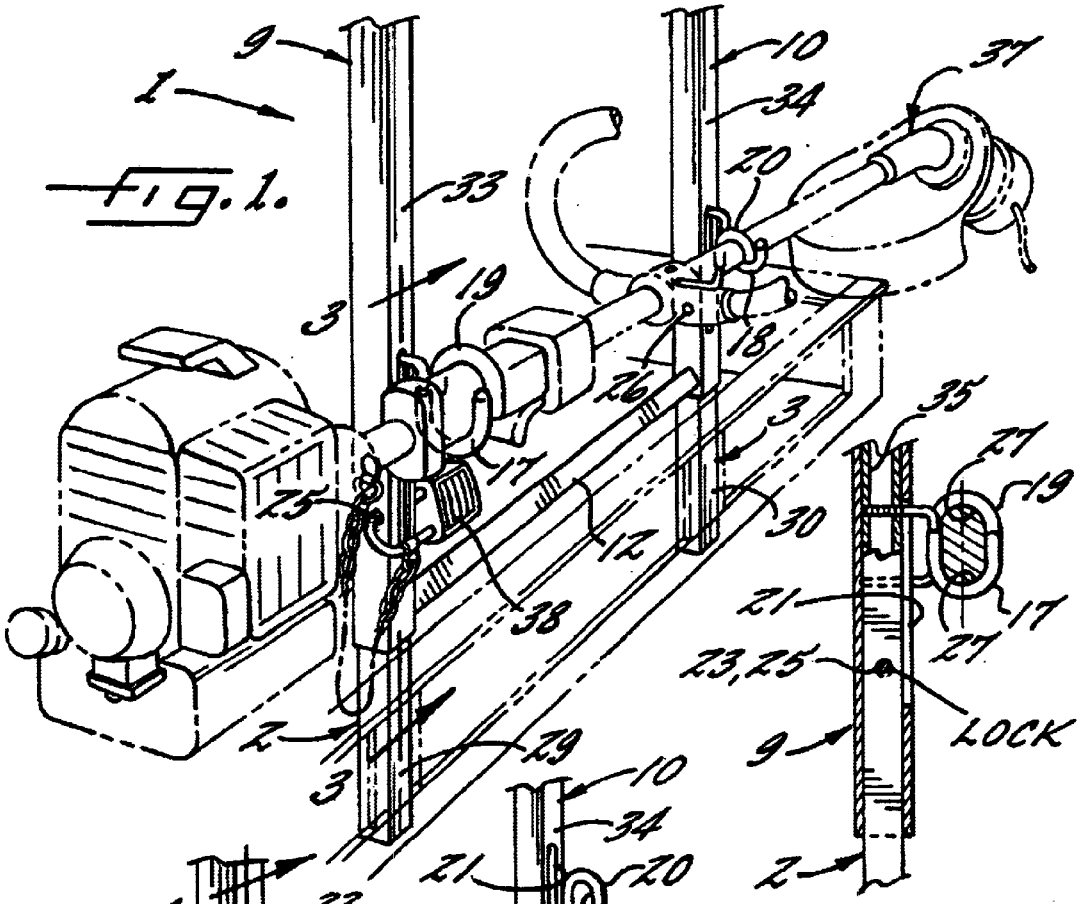
Fig. 1.
Fig. 3.
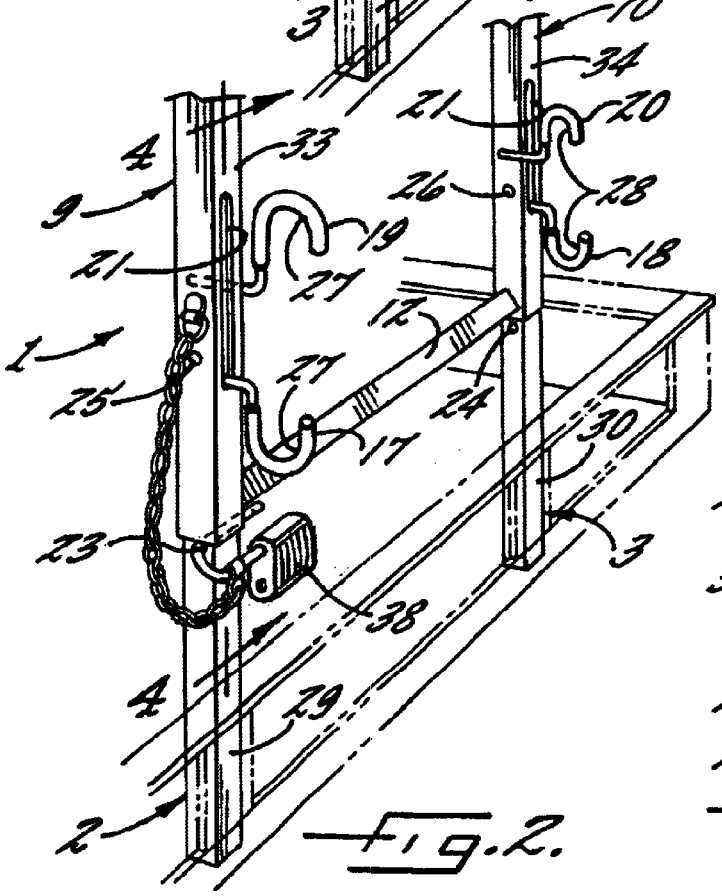
Fig. 2.
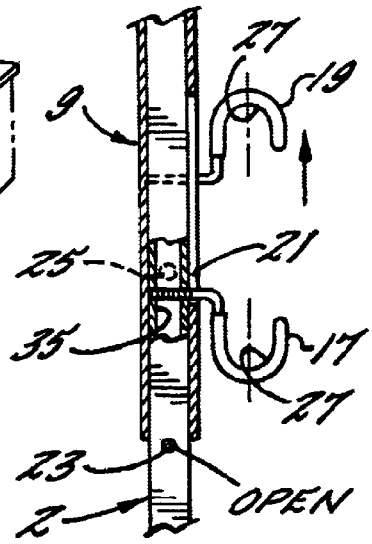
Fig. 4.

LOCKABLE RACK FOR GRASS TRIMMERS

A. BACKGROUND OF THE INVENTION

1. Field of the Invention

The disclosed invention is a lockable rack for storing, transporting and securing lawn equipment including, without limitation, grass trimmers.

2. Description of the Prior Art

People engaged in the lawn care business must transport lawn equipment from the business location to customer locations and from customer location to customer location. Lawn service companies will often transport the lawn equipment in trucks, vans or trailers. One of the essential pieces of equipment used by lawn care companies is a grass and weed cutting tool known as a grass trimmer or "weed eater."

The grass trimmer and other elongated pieces of equipment pose unique storage, transportation and security problems for the lawn care company. Such equipment in general, and the grass trimmer in particular, are difficult to secure, are easily damaged, and can leak gas or oil. The owner has a legitimate interest in decreasing the damage to the equipment, eliminating the loss of gasoline or oil during transportation and preventing theft of the equipment. The public would benefit from a lockable rack capable of mounting in a trailer, truck or van on which grass trimmers can be secured.

The prior art discloses many variations of lawn equipment racks having a number of purposes. Examples are shown in the following U.S. Pat. No. 5,964,358 (Hafendorfer, et al.); U.S. Pat. No. 6,053,339 (Bellis); U.S. Pat. No. 6,073,781 (Puglisi); U.S. Pat. No. 6,302,280 (Bermes); U.S. Pat. No. 6,173,842 B1 (Fitzgerald); and U.S. Pat. No. 5,647,489 (Bellis).

The disclosed invention has a plurality of hooks to fit the shape of the grass trimmer handle and shaft. The hooks may have differing diameters to accommodate the differing diameters of the respective ends of the grass trimmer. In the disclosed invention, the hooks are welded to the inner frame and outer frame thereby eliminating any possibility that someone can dismantle the trimmer rack. The disclosed invention's locking mechanism may hold the rack open for easy removal and replacement of the grass trimmer. The disclosed invention holds securely both ends of the grass trimmer thereby securing the grass trimmer for transport and preventing theft.

The following non-exhaustive discussion describes some of the problems solved by the disclosed invention. U.S. Pat. No. 5,964,358 uses springs and straight pins to hold the lawn equipment into place for transportation only. This mechanism in Patent '358 has no obvious protection against theft. Patent '358 only has hooks on one side and uses a flat steel locking pin. Patent '358 does not secure the equipment as well as the disclosed invention. Patent '358 also requires several motions to lock the rack.

U.S. Pat. No. 5,647,489 has a locking mechanism, but its locking mechanism secures only one end of the grass trimmer. The disclosed invention locks both ends of the grass trimmer in place. Patent '489 also requires several motions to lock and unlock the rack.

U.S. Pat. No. 6,173,842,B has a separate handle to lock and unlock the trimmer rack with a variety of stops and pins located at the bottom of the rack. The hooks in patent '842,B are made of flat steel and the locking pins are straight cylindrical steel. The disclosed invention's hooks are made of round steel on the top and the bottom, which better secure the grass trimmer.

The disclosed invention also possesses other novel and nonobvious features as described below. It is important that the owner or operator can open and close the rack easily and preferably with one hand. It is also beneficial if the rack can be locked to prevent damage to or theft of the grass trimmer.

B. SUMMARY OF THE INVENTION

The disclosed invention provides a lockable rack for grass trimmers that can be installed on a trailer, truck, van or elsewhere. The disclosed invention may be opened and closed with one hand. The disclosed invention provides a sturdy and durable rack that can secure several grass trimmers. One of the prime benefits of the disclosed invention is that it has one simple security feature that secures both ends of the grass trimmers thereby preventing damage and theft.

C. BRIEF DESCRIPTION OF DRAWINGS

FIG. 1 shows a grass trimmer secured in the rack.

FIG. 2 shows a perspective view of a portion of the rack in an open position.

FIG. 3 shows a side view of a portion of the rack 1 in a closed position.

FIG. 4 shows a side view of a portion of the rack in an open position.

Figure 13:
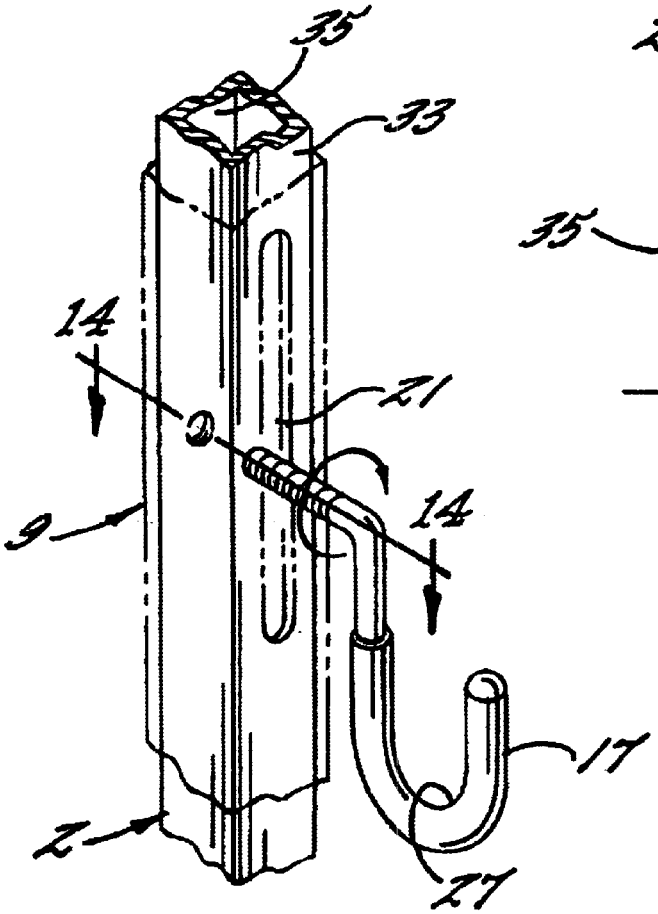

FIG. 13 shows a hook 17 or 18 connected to either the inner frame first vertical member 2 or second vertical member 3.

Figure 14:
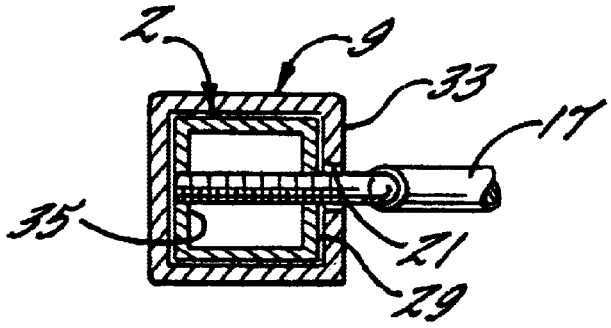

FIG. 14 shows a top view of either the inner frame first vertical member 2 or second vertical member 3.

D. DETAILED DESCRIPTION OF THE INVENTION

FIG. 1 shows the trimmer rack 1 on which a grass trimmer 37 is secured. The trimmer rack 1 has an inner frame first vertical member 2 and an inner frame second vertical member 3. The inner frame first vertical member 2 and the inner frame second vertical member 3 work in substantially the same way and any description of one will apply to the other. The inner frame first vertical member 2 and second vertical member 3 are suitable for mounting on a truck, van or trailer.

As shown in FIGS. 2, 3, 4 and 5, the rack 1 has an outer frame 8 having a first vertical member 9 and second vertical member 10. The outer frame first vertical member 9 slidingly engages the inner frame first vertical member 2. The outer frame second vertical member 10 slidingly engages the inner frame second vertical member 3. The lower cross member 12 serves as a handle for moving the outer frame 8 with respect to the inner frame first vertical member 2 and inner frame second vertical member 3, thereby allowing for the manipulation of the rack 1 to either an open position or a closed position. A padlock 38 is attached to either the outer frame first vertical member 9 or the outer frame second vertical member 10.

FIG. 2 shows the inner frame first vertical member 2 having a hole 23, and the outer frame first vertical member 9 having a hole 25. The inner frame second vertical member 3 has a hole 24. The outer frame second vertical member 10 has a hole 26. When the trimmer rack 1 is closed, the hole 23 aligns with the hole 25, and the hole 24 aligns with the hole 26, so that a padlock 38 or other locking device may be inserted when the rack 1 in the closed position as shown in FIG. 3.

Figure 5:
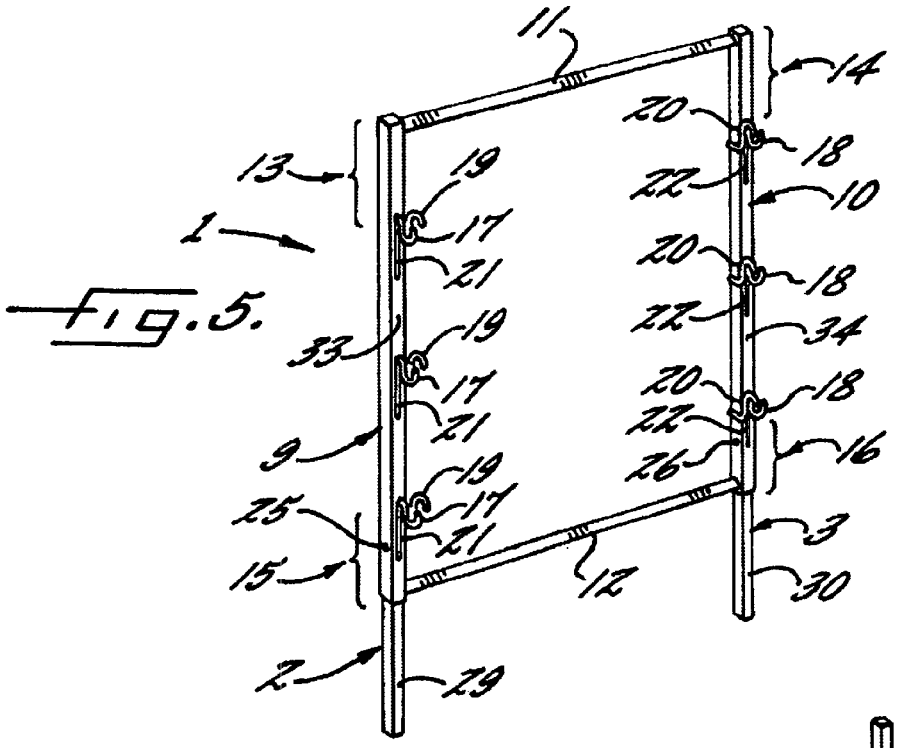
FIG. 5 shows a perspective view of the outer frame engaged to the inner frame.
Figure 6:
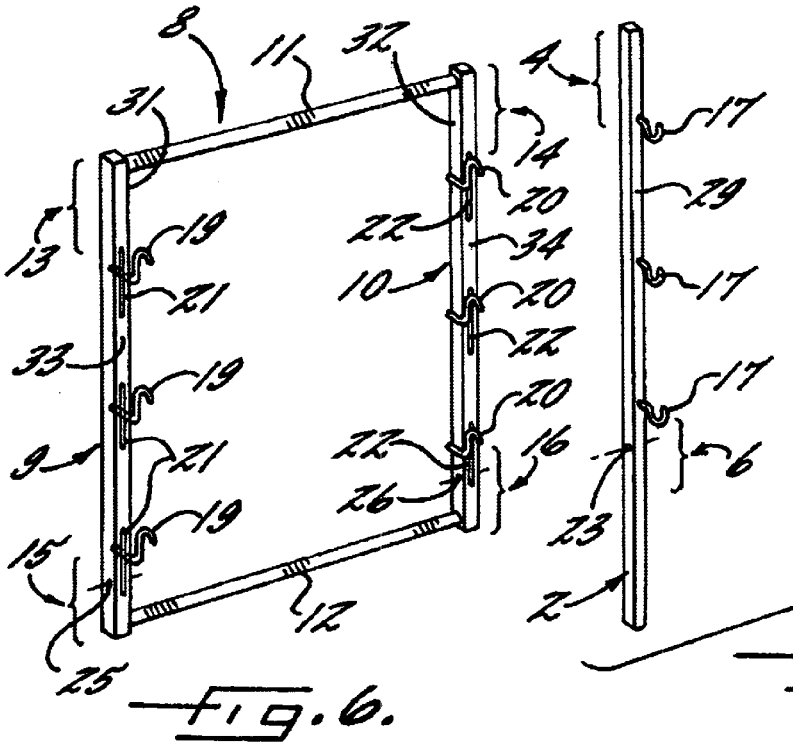
FIG. 6 shows a perspective view of the outer frame.

FIG. 5 shows the outer frame 8 engaging the inner frame first vertical member 2 and inner frame second vertical member 3. FIG. 6 shows the outer frame first vertical member 9 having a plurality of slots 21 and the outer frame second vertical member 10 having a plurality of slots 22. The slots 21 are located on the front side of the outer frame first vertical member 33. The slots 22 are located on the front side of the outer frame second vertical member 34.

FIG. 6 shows the hooks on the outer frame first vertical member 19 attach securely attached to the inside of the outer frame first vertical member 31. The hooks on outer frame second vertical member 20 attach securely to the inside of the outer frame second vertical member 32.

Figure 7:
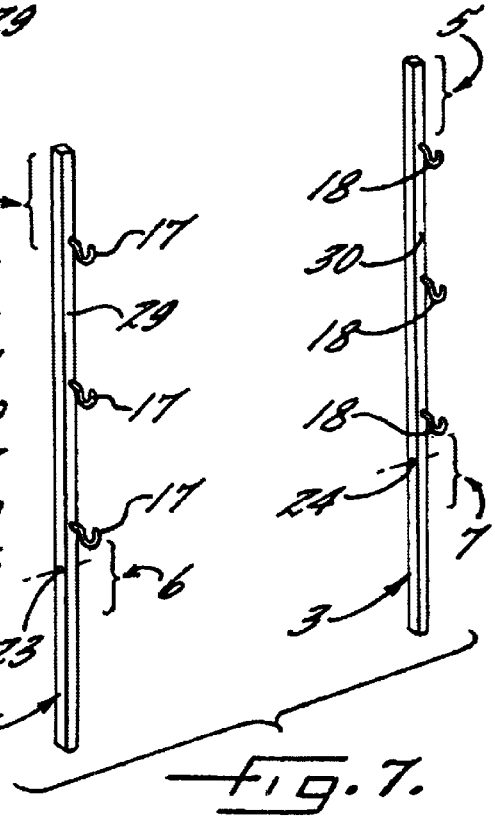
FIG. 7 shows a perspective view of the inner frame first and second vertical members.

As shown in FIG. 7, the inner frame first vertical member 2 has a front side 29. The inner frame second vertical member 3 has a front side 30. The inner frame first vertical member 2 has a top portion 4 and a bottom portion 6. The inner frame second vertical member 2 has a top portion 5 and a bottom portion 7. The inner frame first vertical member 2 has an interior opposite side 35. The inner frame second vertical member has an interior opposite side 36.

FIG. 7 shows the inner frame first vertical member 2 having a plurality of hooks 17 attaching securely to the front side of the inner frame first vertical member 29. The inner frame second vertical member 3 has a plurality of hooks 18 attaching securely to the front side of the inner frame second vertical member 30.

When the outer frame first vertical member 9 engages the inner frame first vertical member 2, the hooks 17 protrude through the slots 21. When the trimmer rack 1 is closed, the hooks on the inner frame first vertical member 17 and the hooks on the outer frame first vertical member 19 secure one end of the grass trimmer. The hooks on the inner frame first vertical member 17 and the hooks on the outer frame first vertical member 19 have an inner diameter 27.

When the trimmer rack 1 is in the closed position, the hooks on the inner frame second vertical member 18 and the hooks on the outer frame first vertical member 20 secure one end of the grass trimmer. The hooks on the inner frame second vertical member 18 and the hooks on the outer frame second vertical member 20 have an inner diameter 28.

As shown in FIG. 6, the outer frame 8 has a first vertical member 9, a second vertical member 10, an upper cross member 11 and a lower cross member 12. The outer frame first vertical member 9 has a top portion 13 and a bottom portion 15. The outer frame second vertical member 10 has a top portion 14 and a bottom portion 16. The hole 25 is located in the bottom portion of the outer frame first vertical member 15 below the lowest hook 17. The hole 26 is located in the bottom portion of the outer frame second vertical member 16 below the lowest hook 20.

The hooks on the outer frame first vertical member 19 are attached to the outer frame first vertical member 9 so that the inner diameter 27 of the hooks 19 face down. The hooks on the outer frame second vertical member 20 are attached to the outer frame second vertical member 10 so that the inner diameter 28 of hooks 20 face down. The hooks on the outer frame first vertical member 19 may be attached above the horizontal midpoint of the slots 21. The hooks on the outer frame second vertical member 20 may be attached above the horizontal midpoint of the slots 22. The exact position of the hooks 19 to the slots 21 and the hooks 20 to the slots 21 is not critical.

The upper cross member 11 is securely attached to the top portion of the outer frame first vertical member 13 and the top portion of the outer frame second vertical member 14. The lower cross member 12 is securely attached to the bottom portion of the outer frame first vertical member 15 and the bottom portion of the outer frame second vertical member 16. The upper cross member 11 and lower cross member 12 provide structural rigidity for the outer frame 8.

As shown in FIG. 7, the inner frame first vertical member has a top portion 4 and a bottom portion 6. The inner frame first vertical member 2 has a plurality of hooks 17. Each hook 17 has an inner diameter 27. The hooks 17 are attached at selected intervals to the front side of the inner frame first vertical member 29 so that the inner diameter 27 faces up. The inner frame second vertical member has 3 has a top portion 5 and a bottom portion 7. The inner frame second vertical member 3 has a plurality of hooks 18. Each of the hooks 18 has an inner diameter 28. The hooks 18 are attached at selected intervals to the inner frame second vertical member 3 so that that inner diameter 28 faces up. The hooks 17 and the hooks 18 are arranged in pairs so that each of the hooks 17 aligns with a corresponding hook 18. FIG. 7 shows three pairs of hooks 17 and 18, but the disclosed invention may have any number of pairs of hooks 17 and 18.

The hole 23 is situated in the bottom portion of the inner frame first vertical member 6 below the lowest hook 17. The hole 24 is situated in the bottom of the inner frame second vertical member 7 below the lowest hook 18.

Figure 8:
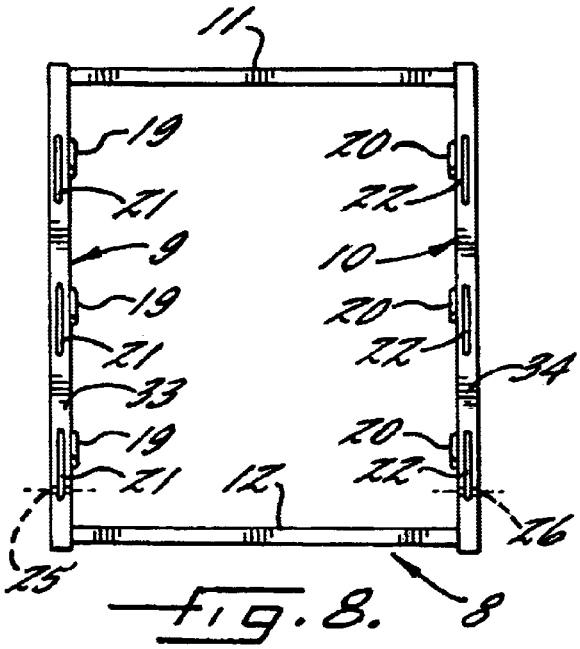
FIG. 8 shows a front view of the outer frame.

As shown in FIG. 8, the slots on the outer frame first vertical member 21 are selectively spaced on the front side of the outer frame first vertical member 33. The slots on outer frame second vertical member 22 are selectively spaced on the front side of the outer frame second vertical member 34. The slots 21 and the slots 22 are arranged in pairs. The hooks on the outer frame first vertical member 19 attach securely to the inside of the outer frame first vertical member 31. The hooks on the outer frame second vertical member 20 attach securely to the inside of the outer frame second vertical member 32.

Figure 9:
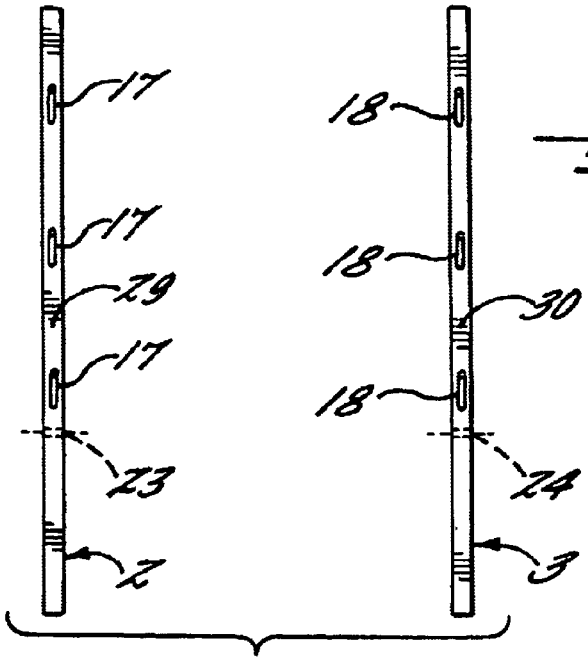
FIG. 9 shows a front view the inner frame first vertical and second vertical members.

FIG. 9 shows a front view of the inner frame first vertical member 2 and second vertical member 3. The hooks on the inner frame first vertical member 17 attach to the front side of the inner frame first vertical member 29. The hooks on the inner frame second vertical member 18 attach to the front side of the inner frame second vertical member 30. The hooks 17 and the hooks 18 are arranged in pairs and are attached respectively to the inner frame first vertical member 2 and inner frame second vertical member 3 at selected intervals. The hole 23 and the hole 24 are located respectively in the bottom portion of the inner frame first vertical member 6 below the lowest hook 17 and in the bottom of the inner frame second vertical member 7 below the lowest hook 18.

Figure 10:
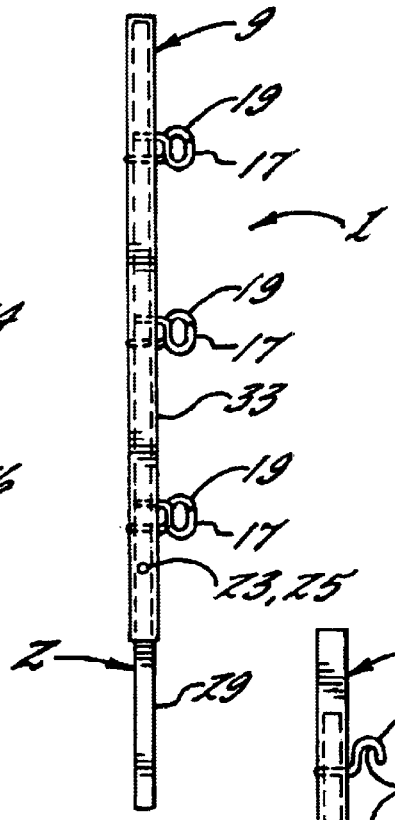
FIG. 10 shows a side view of the rack in the closed position.

FIG. 10 shows a side view of the trimmer rack 1 in the closed position. When the trimmer rack 1 is in the closed position, the hooks 17 and the hooks 19 hold securely the grass trimmer 37. The design of the hooks 17 and the hooks 19 provide an inner diameter 27 that is suitable for securing one end of the grass trimmer 37 preventing rotation, movement and theft.

Figure 11:
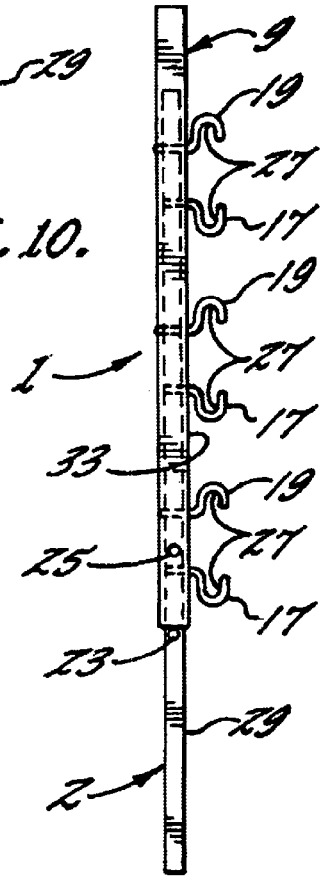
FIG. 11 shows a side view of the rack in the open position.

FIG. 11 shows a side view of the trimmer rack 1 in the open position. The hooks on the outer frame first vertical member 19 are displaced from the hooks on the inner frame first vertical member 17 so as to allow for the insertion or removal of the grass trimmer 37.

When the trimmer rack 1 is open, a padlock 38 may be inserted through either hole 23 or hole 24. The bottom portions of the outer frame 15 or 16 may then rest on the padlock 38 to hold the outer frame 8 in the open position with respect to the inner frame first vertical member 2 and the inner frame second vertical member 3, thereby allowing for the removal of the grass trimmer 37 without the user having to hold the outer frame 8.

Figure 12A:
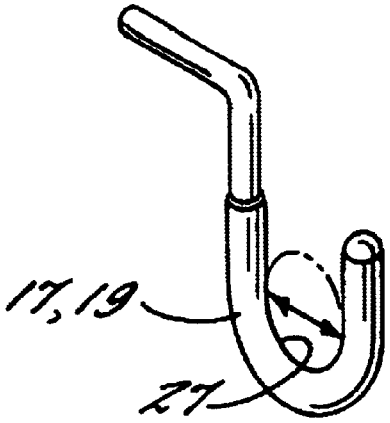
FIG. 12A shows the hooks 17 and 19.

FIG. 12A shows a perspective view of the hooks 17 and 19. The inner diameter 27 of hooks 17 and hooks 19 allowing for the securing of the larger diameter handle end of the grass trimmer 37.

Figure 12B:
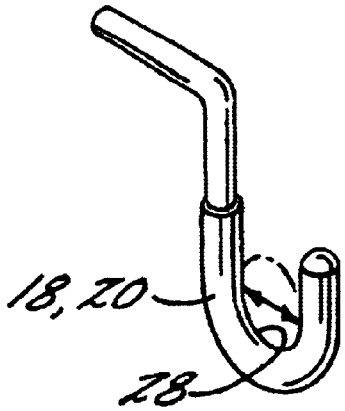
FIG. 12B shows the hooks 18 and 20.

FIG. 12B shows a perspective view of the hooks 18 and 20. The inner diameter 28 of the hooks 18 and the hooks 20 is smaller than the inner diameter 27 allowing for the securing of the smaller diameter bottom end of the grass trimmer 37. The shape and size of all the hooks provide a novel solution to prevent rotation, movement and theft of the grass trimmer 37.

FIG. 13 shows an enlarged view of a portion of the outer frame first vertical member 8 engaging a portion of the inner frame first vertical member 2. The outer frame second vertical member 10 and inner frame second vertical member 3 engage in functionally the same manner. The hook 17 passes through an opening in the front side of inner frame first vertical member 29 and secures to the interior opposite side of the inner frame first vertical member 35. The hook 17 may be welded to the front side of inner frame first vertical member 29. All the hooks 17 and the hooks 18 are secured to the inner frame first vertical member 2 and second vertical member 3 as shown in FIG. 13.

FIG. 14 shows a top view of the outer frame first vertical member 8 engaging the inner frame first vertical member 2. The hook 17 passes through the slot 21 and the front side of the inner frame first vertical member 29 and attaches securely to the interior opposite side of the inner frame first vertical member 35. Again the hooks 18 attach to the inner frame second vertical member 3 in substantially the same manner.

The shapes of the hooks 17, 18, 19 and 20 provide one useful aspect of the disclosed invention. The hooks 17 and the hooks 19 have an inner diameter 27 designed to accommodate the larger handle end of the grass trimmer 37. The hooks 18 and the hooks 20 have an inner diameter 28 that is smaller than the inner diameter 27 to accommodate the smaller end of the grass trimmer 37. When the trimmer rack 1 is closed, the hooks 17 and the hooks 19 securely hold the handle end of the grass trimmer, and the hooks 18 and the hooks 20 securely hold the opposite, smaller end of the grass trimmer.

The preferred embodiment of the disclosed invention uses square tubing made of mild steel. Any sturdy material will work to practice the disclosed invention. In one preferred embodiment, the inner frame first vertical member 2 and second vertical member 3 are compromised of 1" square steel. The outer frame 8 is compromised of 1¼" square steel. The larger sizing of the outer frame 8 allows the outer frame 8 to slide with respect to the inner frame first vertical member 2 and inner frame second vertical member 3, thereby allowing the hooks 19 and 20, respectively, to move away from the hooks 17 and 18, to open the trimmer rack 1.

The angular shapes of the outer frame first vertical member 9 and outer frame second vertical member 10 and the inner frame first vertical member 2 and second vertical member 3 prevent the outer frame first vertical member 9 and outer frame second vertical member 10 from rotating with respect to the inner frame first vertical member 2 and the inner frame second vertical member 3. Square tubing is preferred because it is more readily available and less expensive than other types of suitable frame material. The same result may be obtained by using rectangular tubing or any other angular shape, such as a triangle or pentagon.

The exact size of the outer frame first vertical member 9 and the outer frame second vertical member 10 and inner frame first vertical member 2 and second vertical member 3 is not critical. The type of material used to construct the outer frame 8 and inner frame first vertical member 2 and second vertical member 3 is not critical. The material should be sufficiently rigid to reduce bending, to withstand the continued exposure to the natural elements of sun, rain and snow, and to withstand the stresses of daily use.

In the preferred embodiment, the upper cross member 11 and the lower cross member 12 are made of one-inch angle steel. The outer frame first vertical member 9, the outer frame second vertical member 10, the upper cross member 11 and lower cross member 12 form a generally rectangular shape; however, a portion of the outer frame first vertical member 9 will extend below the point at which the lower cross member 12 is attached, and portion of the outer frame second vertical member 10 will extend below the point at which the lower cross member 12 is attached.

In a preferred embodiment of the disclosed invention, the lower cross member 12 and upper cross member 11 are mounted perpendicular to the outer frame first vertical member 9 and second vertical member 10. The upper cross member 11 and lower cross member 12 could be attached any position relative to the outer frame first vertical member 9 and outer frame second vertical member 10, such as in a diagonal position.

The hole in the outer frame first vertical member 25 and outer frame second vertical member 26, and the hole in the inner frame first vertical member 23 and the inner frame second vertical member 24 serve multiple functions. When the trimmer rack 1 is closed, hole 23 aligns with hole 25 to allow a long-necked padlock 38 to pass through to lock the trimmer rack 1 in a closed position. The hole 24 aligns with the hole 26 to allow a long-necked padlock 38 to pass through to lock the trimmer rack 1 in a closed position. This provides a choice for the consumer to lock one side or the other of the trimmer rack 1 depending, for example, on whether the consumer is right or left handed.

When the trimmer rack 1 is opened, the hole 25 is displaced vertically from the hole 23, and the hole 26 is displaced vertically from the hole 24. The outer frame 8 is moved upward with respect to the inner frame first vertical member 2 and inner frame second vertical member 3 a sufficient distance to allow the consumer to reinsert the padlock 38 into either the hole 23 or the hole 24. The outer frame 8 can be lowered until it comes to rest on the padlock 38, leaving the trimmer rack 1 open.

The disclosed invention allows for holding the outer frame 8 in the open position and for locking the outer frame 8 in the closed position with respect to the inner frame first 2 and second 3 vertical members. This allows the consumer when the rack 1 is in the open lock position to remove or replace the grass trimmers 37. When the outer frame 8 is in the closed position with respect to the inner frame first 2 and second 3 vertical members, both ends of each of the grass trimmer 37 are held securely for transport and are protection against theft.

In the preferred embodiment of the disclosed invention, the hooks 17, 18, 19, and 20 are made of three-eighth's inch (⅜") round steel and are formed to the shape of the grass trimmer handle and shaft respectively. The hooks 17 and 18 are preferably attached to the front side of the inner frame first vertical member 29 and the front side of the inner frame second vertical member 30 by inserting the hooks through an opening in the front side of the inner frame first vertical member 29 and the front side of the inner frame second vertical member 30 and securing the hooks 17 and 18 to an interior opposite side 35 and 36 respectively of the inner frame first vertical member 2 and second vertical member 3 all as shown in FIG. 14.

The hooks 19 and 20 are preferably welded respectively to the inner side of the outer frame first vertical member 31 and the inside of the outer frame second vertical member 32. The welding renders the disclosed invention a unibody-type construction. This unibody type construction serves several purposes. First, it prevents the unwanted dismantling of the rack and the unwanted loosening of fasteners associated with the prior art.

Another benefit of the disclosed invention is that it can be opened and closed with one hand after the padlock 37 is removed from the holes 23 and 25 of the holes 24 and 26.

The disclosed invention can be made from any suitable material or materials and can have any suitable dimensions. The preferred embodiments of the disclosed invention illustrate the invention without limiting the scope of the invention. Those skilled in the art should understand that the Applicant contemplates various modifications and adaptation of the disclosed invention, including alternate embodiments. The described embodiments do not limit the disclosed invention, which encompasses any and all embodiments within the scope of the following claims.

I claim:

1. A grass trimmer rack comprising: an inner frame adaptable for mounting on a trailer or vehicle having a first vertical member and a second vertical member, the inner frame first and second vertical members each having a top portion and a bottom portion, the inner frame first and second vertical members each having a plurality of hooks, the hooks being arranged in pairs, a first hook of each of the pair of hooks being fixedly deposed on the inner frame first vertical member, and a second hook of each of the pairs of hooks being deposed on the inner frame second vertical member, the pairs of hooks being equidistantly spaced along the first and second vertical members, the hooks on the inner frame second vertical member having an internal diameter larger than an internal diameter of the hooks on the inner frame first vertical member; an outer frame movably engaging the inner frame first and second vertical members between an open position and a closed position, the outer frame having a first vertical member and a second vertical member, an upper cross member and a lower cross member, the outer frame first vertical member and the outer frame second vertical member each having a top portion and a bottom portion, the upper cross member rigidly attaching between the top portion of the outer frame first vertical member and the top portion of the outer frame second vertical member, the lower cross member rigidly attaching between the bottom portion of the outer frame first vertical member and the bottom portion of the outer frame second vertical member, the outer frame first vertical member and the outer frame second vertical member each having a plurality of hooks, the hooks being arranged in pairs, the first hook of each of the pairs of hooks being fixedly deposed on the outer frame first vertical member, and a second hook of each of the pairs of hooks being fixedly deposed on the outer frame second vertical member, said pairs of hooks being equidistantly spaced along the outer frame first vertical member and the outer frame second vertical member and adjacent to the pairs of hooks of the inner frame, the outer frame first vertical member and the outer frame second vertical member each having a plurality of slots, the slots being arranged in pairs, wherein the first slot of each of the pairs of slots being located on a front side of the outer frame first vertical member, and the second slot of each of the pairs being located on a front side of the outer frame second vertical member; a means for selectively moving the outer frame with respect to the inner frame first and second vertical members between the opened position and the closed position; the inner frame first vertical member and the inner frame second vertical member each having a hole being selectively placed below the lower most first pair of hooks on the inner frame first vertical member and the inner frame second vertical members, the outer frame first vertical member and the outer frame second vertical members each having a hole being selectively placed below the lower most first pair of hooks on the outer frame first and second vertical members, so that when the rack is in the closed position, the hole in the inner frame first vertical member is aligned with the hole in the outer frame first vertical member and the hole in the inner frame second vertical member is aligned with the hole in the outer frame second vertical member allowing for the passage of a padlock and when the outer frame is in the open position with respect to the inner frame first and second vertical members, allowing for the passage of a padlock through the hole in either the inner frame first vertical member of the inner frame second vertical member, to serve as a support for the outer frame holding the equipment rack in the open position.

2. The grass trimmer rack of claim 1 wherein the hooks on the outer frame first vertical member and the hooks on the inner frame first vertical member have an inner diameter that is larger than an inner diameter of the hooks on the outer frame second vertical member and the hooks on the inner frame second vertical member.

3. The grass trimmer rack of claim 1 wherein the inner frame first vertical member and the inner frame second vertical members are made of one inch square tubing and the outer frame first vertical member and the outer frame second vertical member are made of one and one-half inch square tubing.

4. The grass trimmer rack of claim 1 wherein the plurality of hooks are made of three-eighth's inch round steel and formed generally to a shape of a grass trimmer.

5. The grass trimmer rack of claim 1 wherein the plurality of hooks on the outer frame are welded to an inside of the outer frame first vertical member and an inside of the outer frame second vertical members, the plurality of hooks on the inner frame first vertical member and the inner frame second vertical member passing through a front side of the inner frame first vertical member and a front side of the second vertical member and being attached to an interior opposite side of the inner frame first vertical member and an opposite side of the inner frame second vertical member serving to secure the hooks and to allow the hooks to bear greater weight.

6. A grass trimmer rack comprising: an inner frame adaptable for mounting on a trailer or vehicle having a first vertical member and a second vertical member, the inner frame first and second vertical members each having a top portion and a bottom portion, the inner frame first and second vertical members each having a plurality of hooks, the hooks being arranged in pairs, a first hook of each of the pair of hooks being fixedly deposed on the inner frame first vertical member, and a second hook of each of the pairs of hooks being deposed on the inner frame second vertical member, the pairs of hooks being equidistantly spaced along the first and second vertical members, the hooks on the inner frame second vertical member having an internal diameter larger than an internal diameter of the hooks on the inner frame first vertical member; an outer frame movably engaging the inner frame first and second vertical members between an open position and a closed position, the outer frame having a first vertical member and a second vertical member, an upper cross member and a lower cross member, the outer frame first vertical member and the outer frame second vertical member each having a top portion and a bottom portion, the upper cross member rigidly attaching between the top portion of the outer frame first vertical member and the top portion of the outer frame second vertical member, the lower cross member rigidly attaching between the bottom portion of the outer frame first vertical member and the bottom portion of the outer frame second vertical member, the outer frame first vertical member and the outer frame second vertical member each having a plurality of hooks, the hooks being arranged in pairs, the first hook of each of the pairs of hooks being fixedly deposed on the outer frame first vertical member, and a second hook of each of the pairs of hooks being fixedly deposed on the outer frame second vertical member, said pairs of hooks being equidistantly spaced along the outer frame first vertical member and the outer frame second vertical member and adjacent to the pairs of hooks of the inner frame, the outer frame first vertical member and the outer frame second vertical member each having a plurality of slots, the slots being arranged in pairs, wherein the first slot of each of the pairs of slots being located on a front side of the outer frame first vertical member, and the second slot of each of the pairs being located on a front side of the outer frame second vertical member; a means for selectively moving the outer frame with respect to the inner frame first and second vertical members between the opened position and the closed position; the inner frame first vertical member and the inner frame second vertical member each having a hole being selectively placed below the lower most first pair of hooks on the inner frame first vertical member and the inner frame second vertical members, the outer frame first vertical member and the outer frame second vertical members each having a hole being selectively placed below the lower most first pair of hooks on the outer frame first and second vertical members, the hooks on the outer frame first vertical member and the hooks on the inner frame first vertical member have an inner diameter that is larger than an inner diameter of the hooks on the outer frame second vertical member and the hooks on the inner frame second vertical member, so that when the rack is in the closed position, the hole in the inner frame first vertical member is aligned with the hole in the outer frame first vertical member and the hole in the inner frame second vertical member is aligned with the hole in the outer frame second vertical member allowing for the passage of a padlock and when the outer frame is in the open position with respect to the inner frame first and second vertical members, allowing for the passage of a padlock through the hole in either the inner frame first vertical member of the inner frame second vertical member, to serve as a support for the outer frame holding the equipment rack in the open position, wherein; wherein the inner frame first vertical member and the inner frame second vertical members are made of one inch square tubing and the outer frame first vertical member and the outer frame second vertical member are made of one and one-half inch square tubing, wherein the plurality of hooks are made of three-eighth's inch round steel and formed generally to a shape of a grass trimmer; and wherein the plurality of hooks on the outer frame are welded to an inside of the outer frame first vertical member and an inside of the outer frame second vertical members, the plurality of hooks on the inner frame first vertical member and the inner frame second vertical member passing through a front side of the inner frame first vertical member and a front side of the second vertical member and being attached to an interior opposite side of the inner frame first vertical member and an opposite side of the inner frame second vertical member serving to secure the hooks and to allow the hooks to bear greater weight.

* * * * *